US010689939B1

(12) United States Patent
White

(10) Patent No.: US 10,689,939 B1
(45) Date of Patent: Jun. 23, 2020

(54) DOWNHOLE PLUG

(71) Applicant: Mitchell L. White, Mineola, TX (US)

(72) Inventor: Mitchell L. White, Mineola, TX (US)

( * ) Notice: Subject to any disclaimer, the term of this patent is extended or adjusted under 35 U.S.C. 154(b) by 288 days.

(21) Appl. No.: 15/439,198

(22) Filed: Feb. 22, 2017

(51) Int. Cl.
*E21B 33/12* (2006.01)
*E21B 33/124* (2006.01)
*E21B 33/13* (2006.01)

(52) U.S. Cl.
CPC ..... *E21B 33/1208* (2013.01); *E21B 33/124* (2013.01); *E21B 33/13* (2013.01)

(58) Field of Classification Search
CPC ..... E21B 33/12; F16L 55/12
See application file for complete search history.

(56) References Cited

U.S. PATENT DOCUMENTS 2,851,111 A * 9/1958 Jones ..... E21B 33/1243 166/122
2,927,609 A 3/1960 Vanderlans
3,431,946 A 3/1969 Sawyer
3,971,437 A 7/1976 Clay et al.
4,339,000 A 7/1982 Cronmiller
4,455,027 A 6/1984 Baski
4,526,207 A 7/1985 Burkley et al.
4,565,222 A 1/1986 Lundman
5,101,908 A 4/1992 Mody
5,143,606 A 9/1992 Bernhardt
5,234,034 A 8/1993 Lyon
5,267,617 A 12/1993 Perricone et al.
5,353,842 A 10/1994 Lundman
5,477,886 A 12/1995 Van Beugen et al.
5,782,306 A 7/1998 Serafin
5,857,519 A 1/1999 Bowlin et al.
6,341,654 B1 1/2002 Wilson et al.
6,481,465 B1 11/2002 Warmerdam
6,779,601 B2 8/2004 Wilson et al.
6,899,175 B2 5/2005 Kostrov et al.
7,073,535 B1 7/2006 Warmerdam
7,357,189 B2 4/2008 Aldaz et al.
7,434,616 B2 11/2008 Echols
7,708,070 B2 5/2010 Roelofs
7,735,549 B1 6/2010 Nish et al.
8,474,523 B2 7/2013 Rayssiguier et al.
9,175,549 B2 11/2015 Paturu
(Continued)

FOREIGN PATENT DOCUMENTS

WO WO8501545 A1 4/1985
WO WO9119882 A1 12/1991
(Continued)

OTHER PUBLICATIONS

"Borehole Packers," RST Instruments Ltd., undated, 2 pages. Accessed Jan. 11, 2017, http://www.rstinstruments.com/Brochures/Borehole-Packers-BPB0001P.pdf.
(Continued)

*Primary Examiner* — William D Hutton, Jr.
*Assistant Examiner* — Avi T Skaist
(74) *Attorney, Agent, or Firm* — Yee & Associates, P.C.

(57) ABSTRACT

A plug comprises a pipe having a number of holes, an inlet, and a compound forming a cylinder around a portion of the pipe, the cylinder having a flat top from which protrudes a sealed first end of the pipe and the inlet, and a flat bottom from which protrudes a sealed second end of the pipe.

12 Claims, 7 Drawing Sheets

(56) References Cited

U.S. PATENT DOCUMENTS

| | | | |
|---|---|---|---|
| 2004/0250867 | A1 | 12/2004 | Janc et al. |
| 2013/0312953 | A1 | 11/2013 | Gane |

FOREIGN PATENT DOCUMENTS

| | | | |
|---|---|---|---|
| WO | WO9809054 | A1 | 3/1998 |
| WO | WO2012000580 | A2 | 1/2012 |
| WO | WO2016069240 | A1 | 5/2016 |
| WO | WO2016174191 | A1 | 11/2016 |

OTHER PUBLICATIONS

"Bridge Plug Inflatable Packers," Replacement Inflatable Packers and Elements Pty LTD, undated, 1 page. Accessed Jan. 11, 2017, http://ripe-packers.com/index.php/product-catalog?format=raw&task=download&fid=3169.

"Pump Packer Riserless System," Replacement Inflatable Packers and Elements Pty LTD, undated, 1 page. Accessed Jan. 11, 2017, http://ripe-packers.com/index.php/product-catalog?format=raw&task=download&fid=2631.

* cited by examiner

DOWNHOLE PLUG

BACKGROUND

1. Field

The disclosure relates generally to a plug inserted into a casing of a wellbore to create a seal by expansion of the plug against a wall of the casing. More particularly, the plug may be used in conjunction with a sealed casing to force fluid in the casing through a perforated tubing connected to the plug and up non-perforated tubing for extraction at the wellhead.

2. Description of the Related Art

Inflatable plugs seal or isolate leaks in hydraulic lines, water lines, and gas lines. In the area of hydrocarbon recovery, inflatable or expanding plugs may be employed in order to form a seal downhole by expansion against the walls of a casing. Such plugs are generally lowered by a number of sections of tubing until a desired depth is reached. However, when recovering fluid from the casing above the seal, current methods and apparatus require a pumping action by a rod that extends downward through the casing to the seal. The rod may rub or grate against the casing and create holes in the casing that allow leakage into the wellbore and thereby diminish the flow of extracted fluids.

Therefore, it would be advantageous to have a method and apparatus that takes into account at least some of the issues discussed above, as well as other possible issues.

SUMMARY

In one illustrative embodiment, a plug comprises a pipe having a number of holes in a portion of the pipe, an inlet, and a compound forming a cylinder around the portion of the pipe and a first portion of the inlet, the cylinder having a top from which protrudes a sealed first end of the pipe and a second portion of the inlet, and a bottom from which protrudes a sealed second end of the pipe.

DETAILED DESCRIPTION

Figure 1:
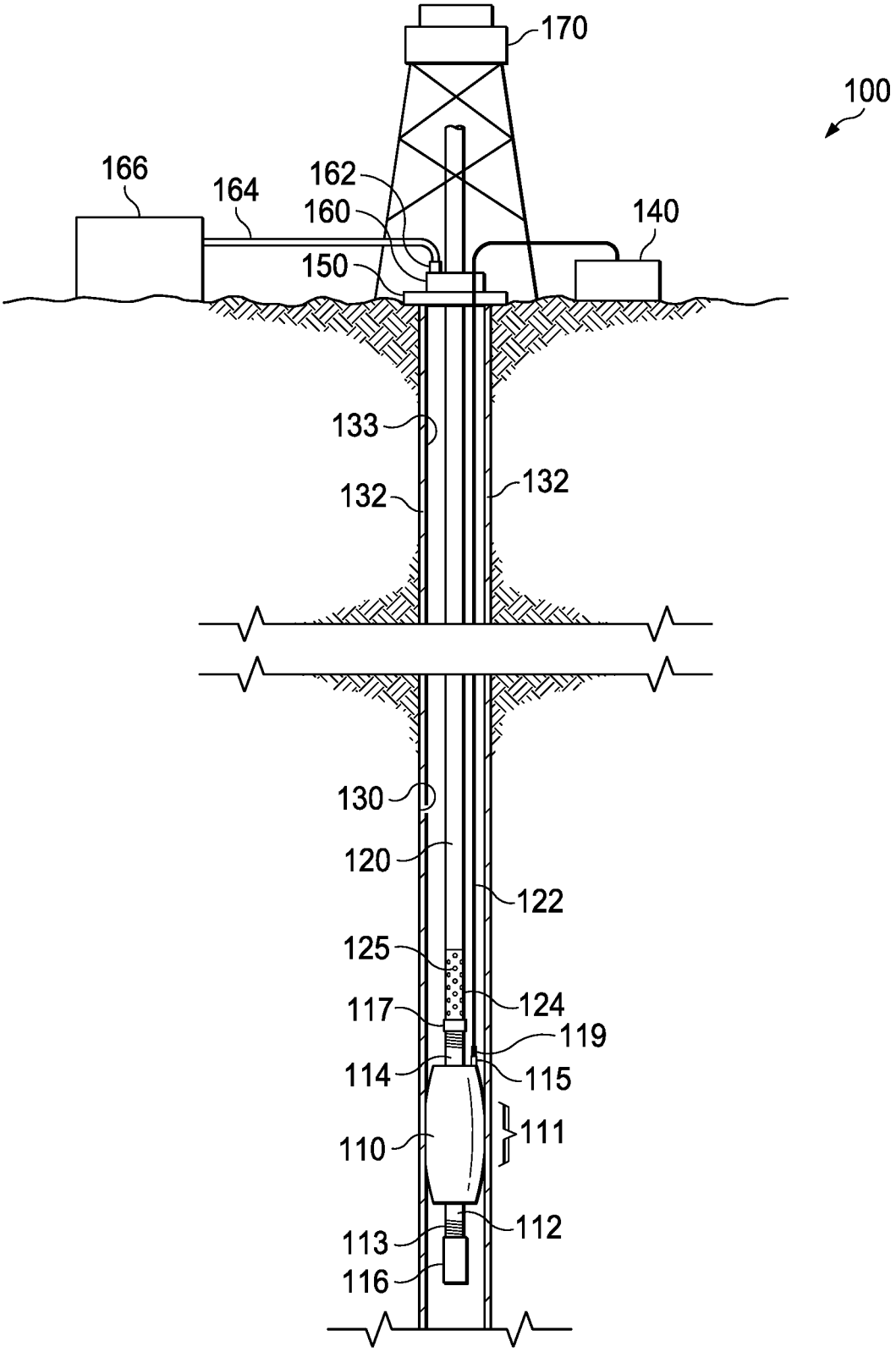
FIG. 1 is a depiction of a wellbore having a casing and a deployed plug in accordance with an illustrative embodiment.

In one illustrative embodiment, a plug comprises a pipe having a number of holes in a portion of the pipe, an inlet, and a compound forming a cylinder around the portion of the pipe and a first portion of the inlet, the cylinder having a top from which protrudes a sealed first end of the pipe and a second portion of the inlet, and a bottom from which protrudes a sealed second end of the pipe.

In another illustrative embodiment, a perforated tubing is attached to the top end of the pipe. The perforated section of tubing may be attached to tubing used to lower the plug down the casing to a desired depth.

In another illustrative embodiment, the plug seals a wellbore lined with a casing. A pressure line connected to the inlet and to a compressor at the well-head forces air or gas into the pipe and through the holes to cause the compound to expand outward against the wall of the casing. The plug forms the seal without moving parts other than expansion of the compound against the casing to form a seal.

In another illustrative embodiment, the well bore may be sealed at the wellhead by a casing seal having a casing seal inlet and configured for passage of tubing and the pressure line while deploying the plug. The plug may be expanded to form a downhole seal at a desired depth. Pressure may be applied into the casing through the casing seal inlet to force fluid in the casing above the seal and through the perforated section of tubing to flow up a chain of tubing, past the casing seal, and out of the wellhead for collection.

In another illustrative embodiment, the plug may be made by taking a length of pipe, drilling holes through the pipe at a mid-section, sealing a first end and a bottom end, and drilling an inlet hole to receive an inlet. A number of spacers may be affixed to the pipe. The pipe may be placed in a cylindrical mold form and a compound inserted into the mold so that after the compound is cured and the cylindrical mold form removed, a cylinder of compound surrounds the pipe, the cylinder of compound having a flat top with the sealed first end of the pipe and the inlet protruding therefrom, and a flat bottom with the sealed second end of the pipe protruding therefrom.

The terminology used herein is for the purpose of describing the particular embodiments only, and is not intended to be limiting of the invention. As used herein, the singular forms "a," "an," and "the" are intended to include the plural forms as well, unless the context clearly indicates otherwise.

It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof.

A number, as used herein with reference to an item, means one or more items.

As used herein, the term "weld" may include tungsten inert gas welding, gas metal arc welding (GMAW), metal inert gas (MIG) welding, and/or metal active gas (MAG) welding.

FIG. 1 is a depiction of a wellbore having a casing and a deployed plug in accordance with an illustrative embodiment. Plug system 100 comprises air compressor 140 in proximity to wellhead 150 connected by pressure line 122 to inlet 115 of plug 110. Wellhead 150 may be a component at a surface of an oil or gas well. Wellhead 150 may provide a structural and pressure-containing interface for drilling and production equipment such as casing 132 and casing seal 160. Casing 132 may be comprised of steel, cement, or any other suitable material known to persons skilled in the art. Derrick 170 may be configured to lower a number of sections of tubing 120 into casing 132. In an illustrative embodiment, derrick 170 may be any device known to persons skilled in the art configured to lower, raise, or suspend tubing and plug 110 for positioning plug 110 within well bore 130.

Tubing 120 may comprise a hollow cylindrical body that may be of any diameter. A section of tubing of one diameter may be joined to one or more sections of tubing of the same diameter to form a chain of tubing that may be referred to collectively as "tubing". An end of tubing 120 may be connected to one end of perforated tubing 124. Plug 110 may be connected to the other end of perforated tubing 124. Plug 110 is shown having expanded outward to engage interior wall 133 of casing 132 to form downhole seal 111. Expansion of plug 110 may be caused by air or gas forced down pressure line 122 from compressor 140. Expansion of plug 110 creates downhole seal 111. Downhole seal 111 may be a three hundred and sixty degree seal against interior wall 133 of casing 132. Plug 110 may form downhole seal 111 without moving parts, other than the expansion of plug 110 against interior wall 133 of casing 132.

Plug 110 may be suspended in casing 132 by perforated tubing 124 and tubing 120. First connector 117 may connect plug 110 to tubing 120. First end 114 of plug 110 may have first connector 117. Second end 112 of plug 110 may have second connector 113. First connector 117 and second connector 113 may be threaded connections. In an illustrative embodiment, first connector 117 may connect with perforated tubing 124 by rotational engagement. Second connector 113 may connect plug 110 to weight 116. Weight 116 may comprise a weight, one or more sections of tubing, or a package of instrumentation. In an illustrative embodiment, second connector 113 may connect with weight 116 by rotational engagement. Alternatively, first connector 117 and second connector 113 may be any connectors known to persons skilled in the art and suitable for purposes of employing plug 110.

Pressure line 122 is connected to inlet 115 of plug 110. Pressure line 122 runs from inlet 115 up and through wellhead 150 and casing seal 160 to compressor 140. Casing seal 160 has casing seal inlet 162 connected by casing seal pressure line 164 to casing compressor 166. In an illustrative embodiment, casing seal 160 may be configured for locking engagement with the wellhead. In an illustrative embodiment, locking engagement may be by a quarter turn or lesser rotation of the casing seal with a locking mechanism (not shown) of wellhead 150.

Casing seal 160 at wellhead 150 may be configured to allow passage of tubing 120 and pressure line 122. When plug 110 forms downhole seal 111 in casing 132, casing seal 160 may sealingly engage tubing 120 and pressure line 122 at well-head 150 to seal casing 132 between downhole seal 111 of plug 110 and casing seal 160 at wellhead 150. Casing seal inlet 162 may be configured for receiving gas or air from casing compressor 166 to create pressure in casing 132 so that pressure may force a liquid (not shown) in casing 132 above plug 110 into perforated tubing 124 and up tubing 120, past casing seal 160 and out of well-head 150 for collection.

Figure 2:
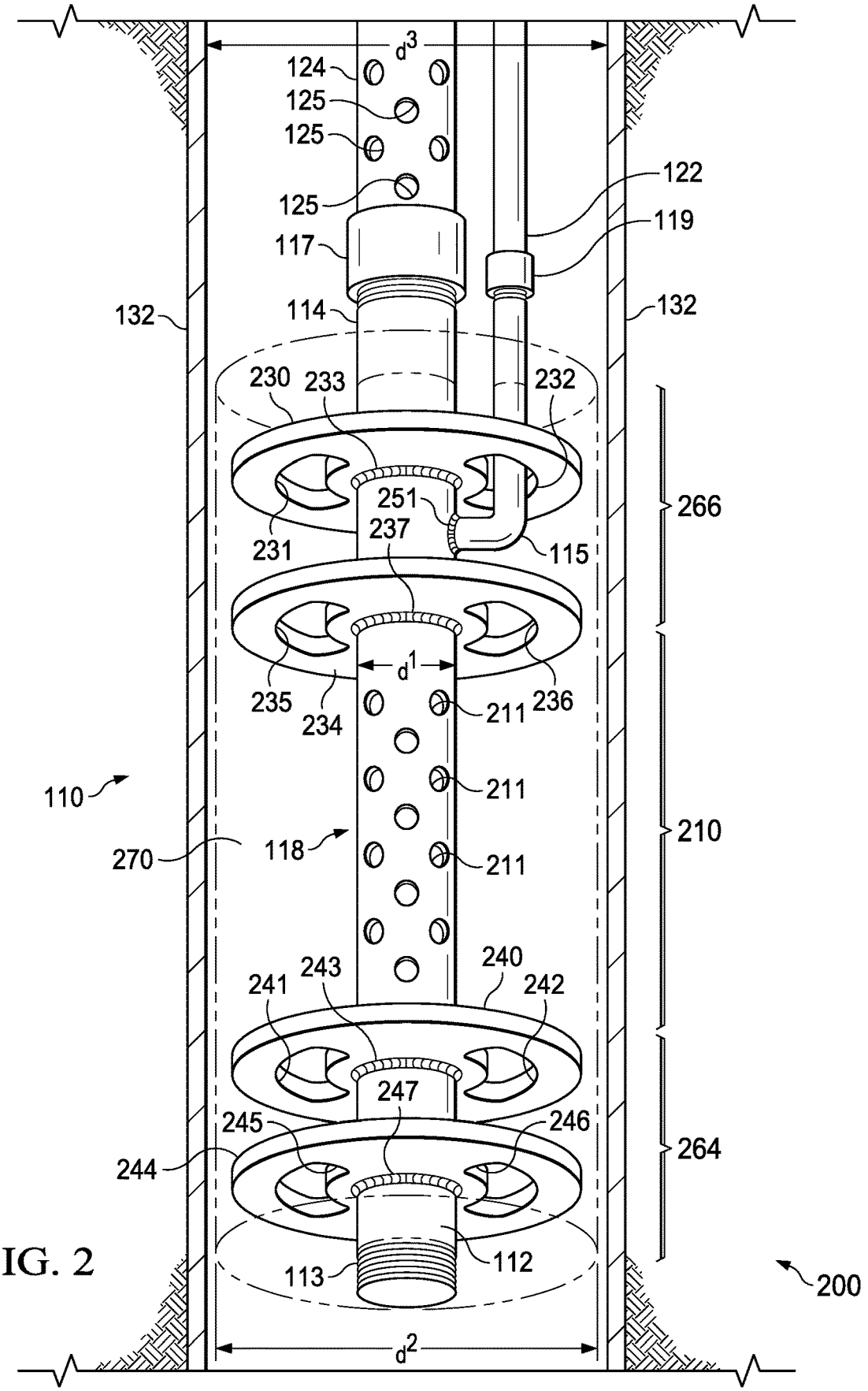
FIG. 2 is an illustration of a downhole plug in accordance with an illustrative embodiment.

FIG. 2 is an illustration of a downhole plug in accordance with an illustrative embodiment. Downhole plug 200 comprises plug 110, perforated tubing 124 connected by first connector 117, and pressure line 122 connected to inlet 115 by inlet connector 119. Perforated tubing 124 has tubing holes 125. Plug 110 may comprise pipe 118, inlet 115, first spacer 230, second spacer 234, third spacer 240, fourth spacer 244, and compound 270. In an embodiment, plug 110 may comprise any number of spacers. In an embodiment, plug 110 may comprise only pipe 118, inlet 115 and compound 270.

Pipe 118 has upper section 266, mid-section 210 and bottom section 264. Pipe 118 may be a length of a hollow cylinder in any diameter capable of having holes drilled in a portion for passage of air from an inside of the hollow cylinder to an outside of the hollow cylinder, capable of being sealed at a first end and a second end, and capable of having an inlet hole introduced for receiving an inlet. Pipe 118 may be formed of any suitable material. In an illustrative embodiment, pipe 118 may be comprised of a metal. In another illustrative embodiment, pipe 118 may be comprised of a metal alloy. In another embodiment, pipe 118 may be comprised of a plastic or a polyvinyl chloride.

First connector 117 connects pipe 118 to perforated tubing 124. Inlet connector 119 connects inlet 115 to pressure line 122. First spacer 230 has aperture 231 and aperture 232, and may be affixed to pipe 118 by first-weld 233. Second spacer 234 has aperture 235 and aperture 236, and may be affixed to pipe 118 by second-weld 237. Third spacer 240 has aperture 241 and aperture 242 and may be affixed to pipe 118 by third-weld 243. Fourth spacer 244 has aperture 245 and aperture 246 and is affixed to pipe 118 by fourth-weld 247.

Mid-section 210 of pipe 118 has holes 211. Holes connect interior of pipe 118 to exterior of pipe 118. Upper section 266 has first end 114. First end 114 has inlet 115 affixed to inlet hole (not shown) by inlet weld 251. Inlet 115 extends outward from upper section 266 of pipe 118 and bends at an approximate ninety degree angle passing through aperture 232 of first spacer 230 and out from compound 270 be joined to pressure line 122 by inlet connector 119. Bottom section 264 has second end 112. Second end 112 has second connector 113. Compound 270 forms a cylindrical mass about a portion of pipe 118, a portion of inlet 115, first spacer 230, second spacer 234, third spacer 240, and fourth spacer 244. Compound 270 fills aperture 231, aperture 232, aperture 235, aperture 236, aperture 241, aperture 242, aperture 245, and aperture 246. Compound 270 does not fill or enter holes 211.

Plug 110 may be designed for any diameter casing. Plug 110 may be constructed for employment in water lines, hydraulic lines, or gas lines of any diameter or circumference. Plug 110 may be constructed so that a diameter of unexpanded plug 110 and an outer circumference of unexpanded plug 110 will be less than the diameter and circumference of the casing, water line, hydraulic line, or gas line in which plug 110 is to be employed. A diameter of compound 270 may be configured for any size casing. In an illustrative embodiment, the diameter of compound 270 is approximately 0.5 inches less than the diameter of the casing such as casing 132 in which plug 110 may be employed.

Compound 270 completely covers first spacer 230, second spacer 234, third spacer 240, and fourth spacer 244 so that a diameter of compound 270 is greater than a diameter of first spacer 230, a diameter of second spacer 234, a diameter of third spacer 240, and a diameter of fourth spacer 244. Compound 270 may comprise a rubber compound or a urethane compound. A composition of compound 270 may be configured for particular applications and for particular sizes of casing. In an embodiment, a composition of compound 270 may be selected to provide a particular degree of hardness and a particular degree of flexibility for expansion at a particular pressure. In an embodiment, a composition of compound 270 may be configured for a particular temperature or range of temperatures. In an embodiment, a composition of compound 270 may be configured for a particular elasticity. Compound 270 completely fills apertures 231, 232, 235, 236, 241, 242, 245, and 246 and contacts all surfaces of spacers 230, 234, 240, and 244.

Compound 270 contacts all surfaces of pipe 118, except for the interior of pipe 118, holes 211, and portions of first end 114 and second end 112 that extend beyond compound 270. Compound 270 contacts all surfaces of inlet 115 except for a portion of inlet 115 that extends beyond compound 270. As used herein "contact" means a tight and sealing engagement substantially without air pockets or bubbles so that compound 270 forms a solid cylindrical mass except for the space taken up by interior of pipe 118, holes 211, and portions of first end 114 and second end 112 that extend beyond compound 270.

Furthermore, mid-section 210, having holes 211, is isolated by compound 270 surrounding second spacer 234 and third spacer 240 and filling apertures 235, 236, 241, and 242 and by second-weld 237 and third-weld 243 so that when compressed air or gas is introduced by pressure line 122 through inlet 115 into interior of pipe 118, the air or gas will press only through holes 211 to force compound 270 into contact with mid-section 210 of pipe 118 to expand outward until an outer circumference of compound 270 sealingly engages an interior wall of casing 132. The interior wall may be interior wall 133 in FIG. 1.

Figure 3A:
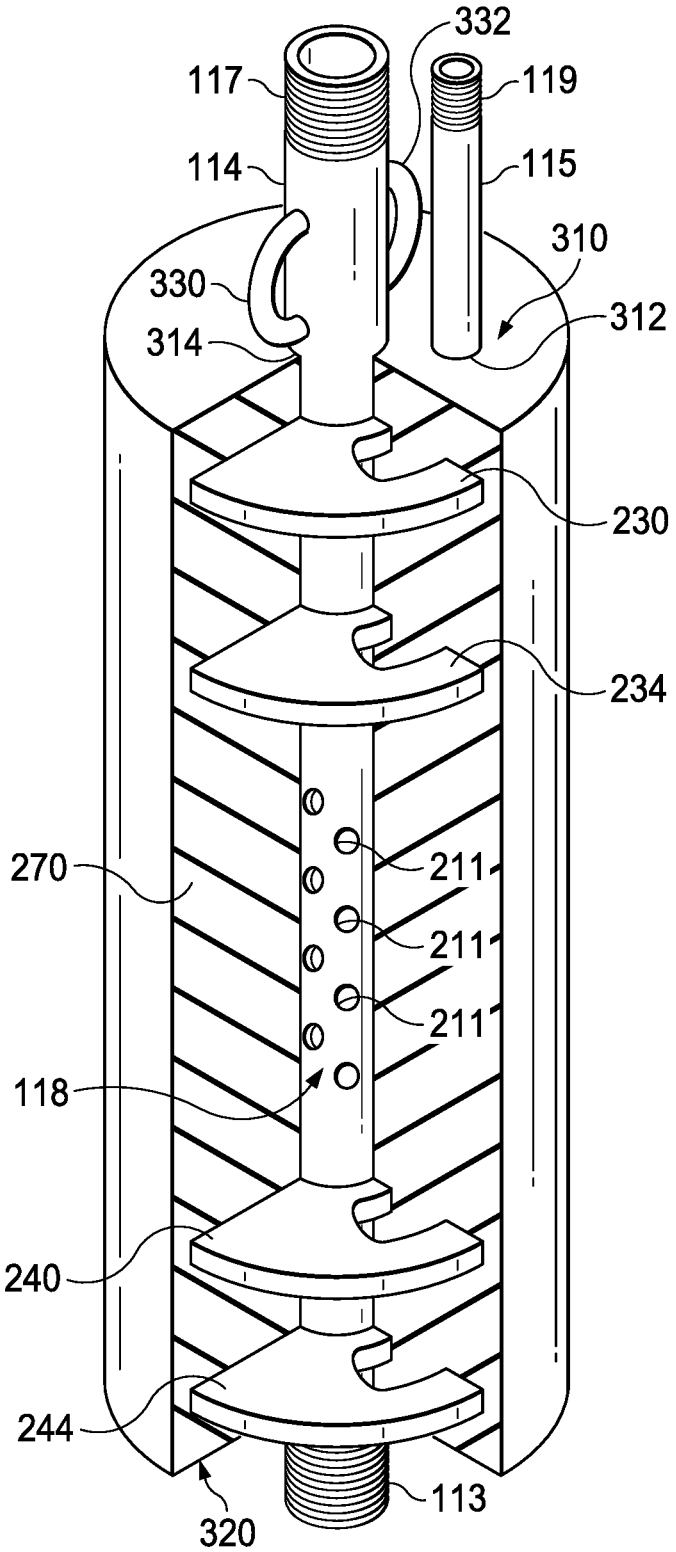
FIG. 3A is a cutaway view of the downhole plug in accordance with an illustrative embodiment.

FIG. 3A is a cutaway view of the downhole plug in accordance with an illustrative embodiment. First end 114 extends out of compound 270 shown in FIG. 2. Inlet 115 extends out of compound 270. Compound 270 forms a cylindrical mass about pipe 118, first spacer 230, second spacer 234, third spacer 240, and fourth spacer 244. Compound 270 fills apertures 231, 232, 235, 236, 241, 242, 245, and 246, all shown in FIG. 2. Compound 270 does not fill or enter holes 211. In the embodiment of FIG. 3A, hangers 330 and 332 are fixedly engaged to first end 114 of pipe 118. Hangers 330 and 332 may be used for extraction of plug 110 in the event tubing 120 (see FIG. 1) breaks. Lines and hooks (not shown) may be sent down a casing to engage hangers 330 and 332 for extraction of plug 110. In an illustrative embodiment, compound 270 has flat top 310 and flat bottom 320. Pipe 118 extends out of flat top 310 of compound 270 at pipe interface 314. Inlet 115 extends out of flat top 310 of compound 270 at inlet interface 312. Pipe interface 314 and inlet interface 312 contact pipe 118 in the same manner as surfaces discussed above in FIG. 2.

Figure 3B:
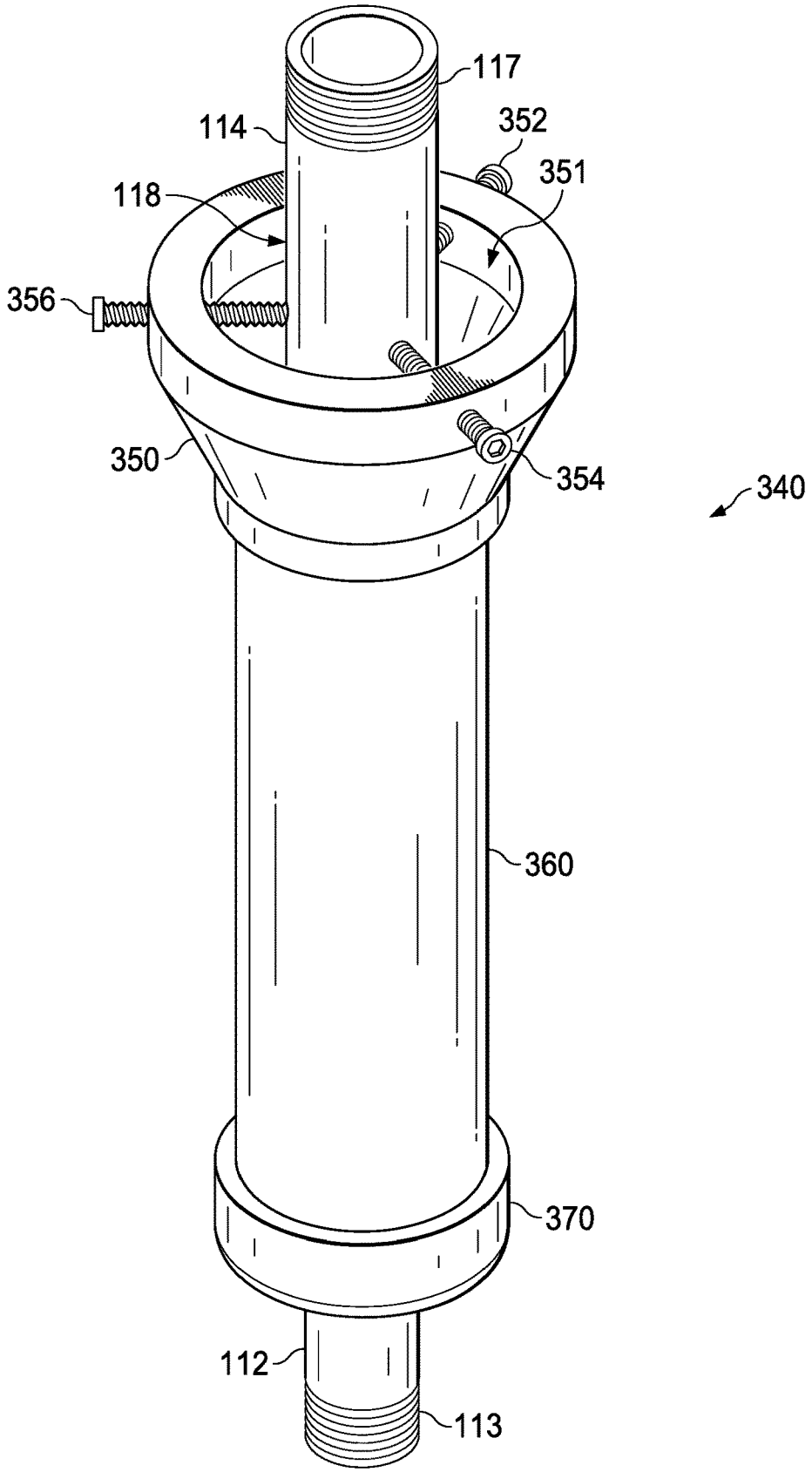
FIG. 3B is an illustration of a mold for making a downhole plug in accordance with an illustrative embodiment.

FIG. 3B is an illustration of a mold for making the downhole plug in accordance with an illustrative embodiment. Mold 340 has top cap 350, center body 360, and end cap 370. Stabilizers 352, 354, and 356 allow for the adjustment of pipe 118 in mold 340. End cap 370 may engage center body 360 by friction fit. Top cap 350 may engage center body 360 by friction fit. Pipe 118 is aligned in mold 340 by inserting second end 112 into a circular hole (not shown) in end cap 370. Stabilizers 352, 354, and 356 may be employed to align pipe 118 vertically within mold 340 to ensure uniform diameter and circumference of compound 270 (see FIG. 2 and FIG. 3A). Stabilizers 352, 354, and 356 may be employed to position pipe 118 so that second end 112 extends out of end cap 370 at a predetermined distance so that flat bottom 320 of cylinder 270 may be formed at a predetermined distance from flat top 310 of cylinder 270 (see 270, 310, and 320 in FIG. 3B).

Figure 4:
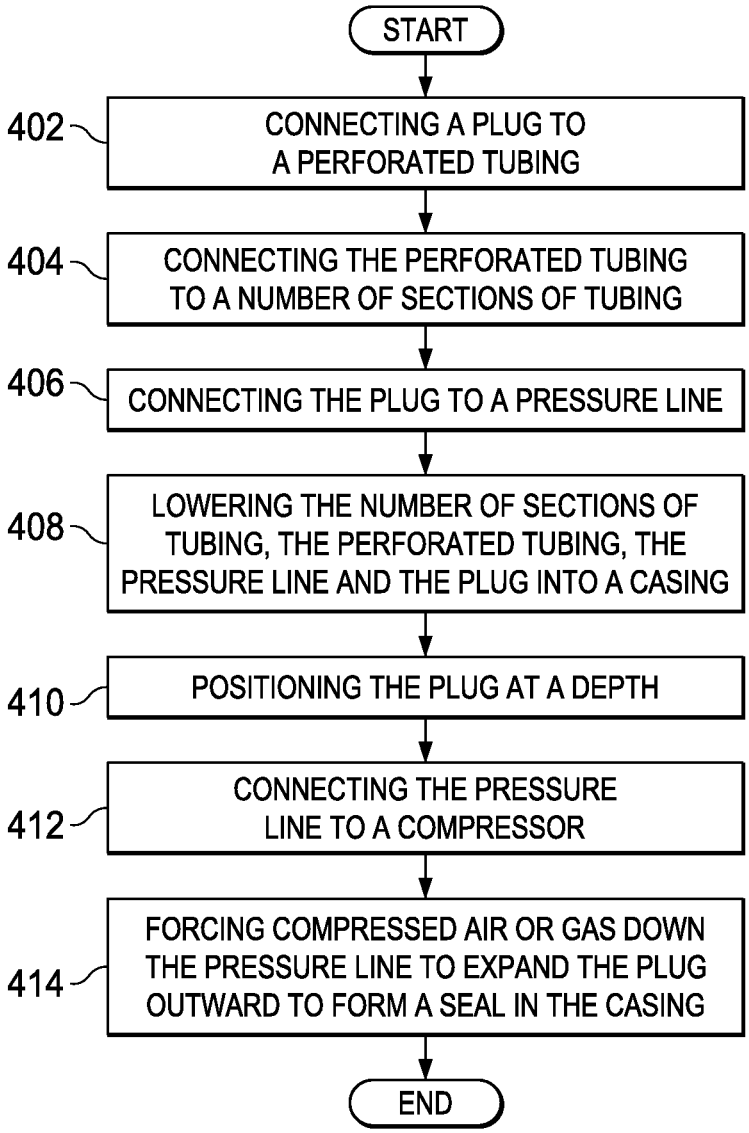
FIG. 4 is a flowchart of a process for employing a downhole plug in accordance with an illustrative embodiment.

FIG. 4 is a flowchart of a process for employing a downhole plug in accordance with an illustrative embodiment. A plug is connected to a perforated tubing (step 402). The plug may be plug 110 in FIG. 1 and FIG. 2. The perforated tubing may be perforated tubing 124 in FIG. 1 and FIG. 2. The perforated tubing is connected to a number of sections of tubing (step 404). The number of sections of tubing may be tubing 120 in FIG. 1. A pressure line is connected to the plug (step 406). The pressure line may be pressure line 122 in FIG. 1 and FIG. 2. The number of sections of tubing, the perforating tubing, the pressure line, and the plug are lowered into the casing (step 408). The number of sections of tubing, the perforating tubing, the pressure line, and the plug may be lowered into the casing by a drilling device such as derrick 170 in FIG. 1.

As each succeeding section of tubing is lowered, another section may be attached so that the number of sections of tubing is extended until the perforated tubing and the plug descend into the casing and a desired depth is reached. When the desired depth is reached, the down-hole plug is positioned at the desired depth (step 410). By "positioning" it is meant that downward movement of the tubing is stopped and the tubing locked so that the downhole plug is held at the desired depth. A top end of the pressure line is connected to a compressor (step 412). The compressor may be compressor 140 in FIG. 1. Compressed air or gas may be forced down the pressure line to expand the plug outward to form a seal in the casing (step 414). The compound of the plug expands against the wall of the casing so that the seal engages the wall of the casing for a full three hundred and sixty degrees. The process terminates thereafter. The compound may be compound 270 in FIG. 2 and FIG. 3A.

Figure 5:
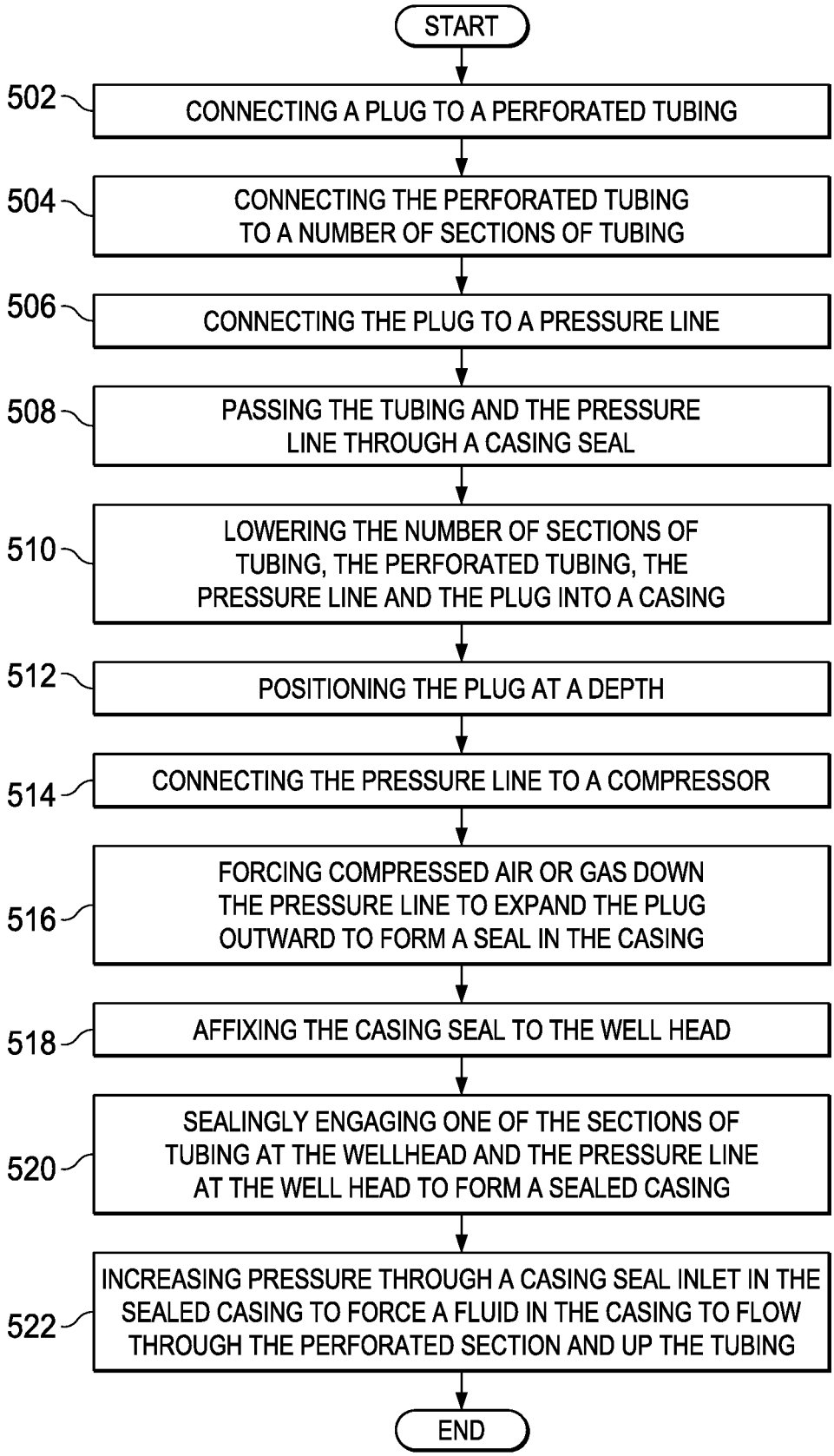
FIG. 5 is a flowchart of a process for employing a downhole plug and casing seal in accordance with an illustrative embodiment.

FIG. 5 is a flowchart of a process for employing a downhole plug and casing seal in accordance with an illustrative embodiment. A plug is connected to a perforated tubing (step 502). The plug may be plug 110 in FIG. 1, FIG. 2, and FIG. 3A. The perforated tubing may be perforated tubing 124 in FIG. 1 and FIG. 2. The section of perforated tubing is connected to a number of sections of tubing (step 504). The number of sections of tubing may be tubing 120 in FIG. 1. A pressure line is connected to the plug (step 506). The tubing and the pressure line are passed through a casing seal (step 508). The casing seal may be casing seal 160 in FIG. 1. The number of sections of tubing, the perforated tubing, the pressure line, and the plug are lowered into the casing (step 510). The number of sections of tubing, the perforating tubing, the pressure line, and the plug may be lowered into the casing by a drilling device, such as derrick 170 in FIG. 1. As each succeeding section of tubing is lowered, another section may be attached so that the number of sections of tubing is extended until the perforated tubing and the plug descend into the casing and a desired depth is reached.

When the desired depth is reached, the plug is positioned at a depth (step 512). By "positioning" it is meant that downward movement of the tubing is stopped and the tubing locked so that the down-hole plug is held at the desired depth. A top end of the pressure line is connected to a compressor (step 514). The compressor may be compressor 140 in FIG. 1. Compressed air or gas is forced down the pressure line to expand the plug outward to form a seal in the casing (step 516). The compound of the plug expands against the wall of the casing so that the seal engages the wall of the casing for a full three hundred and sixty degrees. The compound may be compound 270 in FIG. 2 and FIG. 3. The casing seal is affixed to the wellhead (step 518). The casing seal may be casing seal 160 in FIG. 1.

One of the sections of tubing at the wellhead and the pressure line at the wellhead are sealingly engaged to form a sealed casing (step 520). Sealing engagement is performed by the casing seal. In an embodiment, the casing seal may be affixed to the wellhead by locking engagement with the wellhead. The wellhead may be wellhead 150, the tubing may be tubing 120 and the pressure line may be pressure line 122 in FIG. 1. Pressure is increased through a casing seal inlet in the sealed casing to force a fluid in the casing to flow through the perforated tubing and up the tubing (step 522). The process terminates thereafter. The casing seal inlet may be casing seal inlet 162 in FIG. 1. A casing seal inlet may be affixed to a casing seal pressure line and air or gas forced into the casing by a casing compressor. The casing seal pressure line may be casing seal pressure line 164 in FIG. 1. The casing compressor may be casing compressor 166 in FIG. 1.

Figure 6:
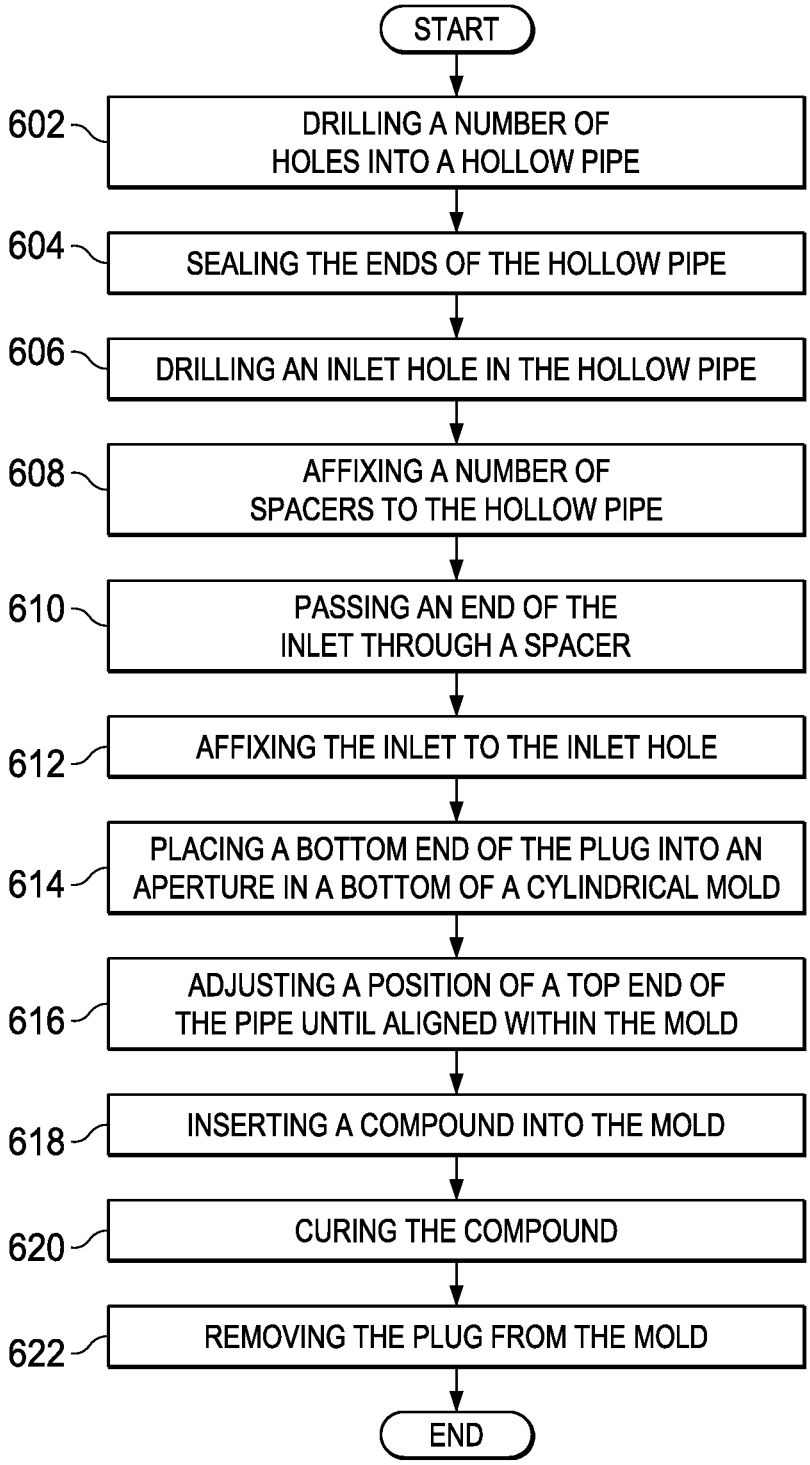
FIG. 6 is a flowchart of a process for making a downhole plug in accordance with an illustrative embodiment.

FIG. 6 is a flowchart of a process for making a downhole plug in accordance with an illustrative embodiment. A number of holes are drilled in a hollow pipe (step 602). The pipe may be pipe 118 and the holes may be holes 211 in FIG. 2 and FIG. 3A. The ends of the pipe are sealed (step 604). An inlet hole is drilled into the pipe (step 606). The inlet hole may be inlet hole (not shown) affixed to inlet 115 by inlet weld 251 in FIG. 2. A number of spacers are affixed to the pipe (step 608). The spacers may be spacers 230, 234, 240, and 244 in FIG. 2 and FIG. 3. The spacers may be rigidly affixed to the hollow pipe by welding. The welds may be first-weld 233, second-weld 237, third-weld 243, and fourth-weld 247 in FIG. 2. An end of an inlet is passed through an aperture on a spacer (Step 610). The inlet is affixed to the inlet hole (step 612). The inlet may be inlet 115 in FIG. 2. Inlet 115 may be affixed by inlet weld 251 in FIG. 2. The aperture may be first aperture 231 in FIG. 2. The holes may be plugged with Styrofoam®. In an illustrative embodiment, the holes may be covered with tape. A second end of the pipe is placed into an aperture in a bottom of a cylindrical mold (step 614). A position of a first end of the pipe is adjusted until aligned in the mold (step 616). The first end of the pipe may be affixed to a mechanism that is adjusted to align the pipe within the mold so that an exterior of the pipe will be equidistant from an interior wall of the mold. In an illustrative embodiment, stabilizers 352, 354, and 356 may be employed to engage first end 114 to align pipe 118 vertically within mold 340 to ensure uniform diameter and circumference of compound 270 (see FIGS. 2, 3A and 3B). A compound may be inserted into the mold (step 618). In an illustrative embodiment, the compound may be poured into the mold. In another illustrative embodiment, the compound may be injected into the mold. The compound may be inserted into the mold through an opening in a top end of the mold. In an illustrative embodiment, the opening may be opening 351 in top end 350 of mold 340 in FIG. 3B. The compound is cured (step 620). The plug may be removed from the mold (step 622). The process terminates thereafter. The Styrofoam® plugs in the holes may be dissolved by pouring a solvent into the pipe through the inlet. The solvent may be acetone, gasoline, or any other suitable type of solvent. If tape has been used to cover the holes, the tape may break when pressure is applied to the inside of the pipe through the inlet. In an illustrative embodiment, the tape may dissolve by introduction of a solvent into the interior of the pipe through the inlet.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiment. The terminology used herein was chosen to best explain the principles of the embodiment, the practical application, or technical improvement over technologies found in the marketplace, or to enable others of ordinary skill in the art to understand the embodiments disclosed herein.

The flowcharts and block diagrams in the figures illustrate the architecture, functionality, and operation of possible implementations of systems, methods, and computer program products according to various embodiments of the present invention. It should also be noted that, in some alternative implementations, the functions noted in the blocks may occur out of the order noted in the figures. For example, two blocks shown in succession may, in fact, be performed substantially concurrently, or the blocks may sometimes be performed in the reverse order, depending upon the functionality involved.

What is claimed is:

1. A plug system comprising:

an air compressor connected by a pressure line to an inlet;

a drilling device configured to lower a number of sections of tubing into a casing;

a perforated tubing connected to an end of the number of sections of tubing; and a plug having a pipe connected to the perforated tubing, the pipe having a number of holes in a portion of the pipe, the inlet connected to the pipe and configured to introduce compressed air from the air compressor directly into an interior of the pipe, and a compound forming a cylinder around the number of holes, the cylinder having a top from which protrudes a sealed first end of the pipe and the inlet, and a flat bottom from which protrudes a sealed second end of the pipe.

2. The plug system of claim 1, further comprising:

a downhole seal formed without moving parts other than expansion of the compound against a wall of the casing to form the downhole seal.

3. The plug system of claim 2, further comprising:

a casing seal configured to allow passage of the number of sections of tubing and the pressure line during deployment of the plug, and configured to sealingly engage a section of the number of sections of tubing and the pressure line after deployment of the plug.

4. The plug system of claim 3, further comprising:

a casing seal inlet for receiving gas or air to create a pressure in the casing, wherein the pressure forces a liquid in the casing above the downhole seal into the perforated tubing and up the number of sections of tubing, past the casing seal, and out of a wellhead for collection.

5. The plug system of claim 1, wherein the compound engages exterior surfaces of the portion of the pipe and a number of spacers affixed to the portion of the pipe but does not enter into the number of holes.

6. The plug system of claim 1, wherein the pipe has a first diameter, the compound in an unexpanded state has a second diameter, and the casing has a third diameter, wherein the first diameter is less than the second diameter and the second diameter is less than the third diameter.

7. The plug system of claim 1, wherein the portion of the pipe includes an upper section having a spacer and a connection of the inlet to the pipe, a mid-section having the number of holes, and a bottom section having a second spacer.

8. The plug system of claim 1, wherein the inlet has a first portion connected to the pipe and surrounded by the compound and a second portion extending from the compound and connected to the pressure line.

9. The plug system of claim 1, wherein the pipe includes a first spacer, a second spacer, a third spacer, and a fourth spacer wherein the inlet passes through the first spacer.

10. The plug system of claim 9, wherein the compound completely covers the first spacer, the second spacer, the third spacer, and the fourth spacer such that a diameter of the compound in an unexpanded state is greater than a diameter of first spacer, the second spacer, the third spacer, and the fourth spacer.

11. A downhole plug comprising:

a perforated tube connected to a first sealed end of a pipe;

a first spacer affixed to an upper section of the pipe and a second spacer affixed to a bottom section of the pipe;

a number of holes formed in the pipe between the upper section and the bottom section;

an expandable cylinder formed around the pipe and configured to cover the first spacer and the second spacer but not enter the number of holes; and an air pressure inlet connected to the pipe and configured to introduce compressed air directly into an interior of the pipe;

wherein the first sealed end of the pipe, a second sealed end of the pipe, and the air pressure inlet extend from the expandable cylinder.

12. The downhole plug of claim 11, wherein expansion of the expandable cylinder creates a downhole seal in a bore and wherein pressure within the bore forces a liquid or gas in the bore above the downhole seal into the perforated tube for collection outside of the bore.

* * * * *